United States Patent [19]

Neudeck

[11] 4,236,577

[45] Dec. 2, 1980

[54] SEPARATELY REMOVABLE TUBES IN HEAVY DUTY HEAT EXCHANGER ASSEMBLIES

[75] Inventor: Gene T. Neudeck, Franklin, Wis.

[73] Assignee: McQuay-Perfex, Inc., Milwaukee, Wis.

[21] Appl. No.: 916,000

[22] Filed: Jun. 16, 1978

[51] Int. Cl.[3] ..... F28F 9/06

[52] U.S. Cl. ..... 165/175; 165/178; 285/20; 285/31; 285/137 R; 285/158; 285/196

[58] Field of Search ..... 16/2; 165/76, 82, 173, 165/175, 178, 69; 285/158, 189, DIG. 19, 19, 20, 31, 32, 196, 162, 338, 137 R

[56] References Cited

U.S. PATENT DOCUMENTS

| | | | |
|---|---|---|---|
| 1,412,056 | 4/1922 | Hughes et al. | 165/76 |
| 1,601,226 | 9/1926 | Smith | 165/76 |
| 2,225,856 | 12/1940 | Buck | 165/69 |
| 3,263,747 | 8/1966 | McKay | 165/178 |
| 3,391,732 | 7/1968 | Murray | 165/76 |
| 4,044,443 | 8/1977 | Chartet | 165/173 |
| 4,120,352 | 10/1978 | Husson | 165/173 |

FOREIGN PATENT DOCUMENTS

| | | | |
|---|---|---|---|
| 21822 | 5/1883 | Fed. Rep. of Germany | 285/19 |
| 626578 | 2/1936 | Fed. Rep. of Germany | 285/19 |
| 1205564 | 11/1965 | Fed. Rep. of Germany | 165/178 |
| 2009122 | 9/1970 | Fed. Rep. of Germany | 165/178 |
| 1275943 | 12/1961 | France | 165/81 |
| 621694 | 6/1961 | Italy | 165/178 |
| 535415 | 5/1973 | Switzerland | 165/82 |

*Primary Examiner*—Sheldon Richter

*Attorney, Agent, or Firm*—Andrus, Sceales, Starke & Sawall

[57] ABSTRACT

The invention is directed to removable heat exchanger tube assemblies in heavy duty equipment radiators in which the tubes are each separately removable if they become defective in service. An inwardly facing annular ledge or abutment is molded into the inside diameter of each upper and lower sealing member to receive the respective ends of the tubes and prevent vertical movement of the tubes in service. A flange or shoulder is also provided on the lower portions of each tube and engages the inside of the lower sealing member to further restrain downward movement of the tubes in service. Each tube may be removed by pushing the tube upwardly to overcome the upper ledge abutment and thereby lift the tube free of the lower seal. Each tube may then be removed sidewise from the radiator. Variations of the removable sealing arrangement can be made and are described herein.

2 Claims, 9 Drawing Figures

SEPARATELY REMOVABLE TUBES IN HEAVY DUTY HEAT EXCHANGER ASSEMBLIES

BACKGROUND OF THE INVENTION

The prior art patents directed to tubes removable from radiators or heat exchangers are best illustrated by Murray U.S. Pat. No. 3,391,732, Smith U.S. Pat. No. 1,601,226 and British Pat. No. 502,604. The present invention presents a new and novel sealing construction for installing and holding removable heat exchanger tube assemblies in heavy duty radiators permitting ready removal of each individual tube should it become defective without having to remove the headers or other parts of heavy duty radiators or other heat exchangers.

SUMMARY OF THE INVENTION

The invention has several embodiments. The best mode of the invention is directed to the first embodiment in which an assembly of heat exchanger tubes having the usual fins are received in upper resilient sealing members lodged in apertures in a header supporting plate which is also provided as a support for the upper header of the assembly. Each sealing member has an inner diameter which is of a size so that the seal expands when the upper end of a tube is inserted therein to provide a liquid tight seal around the tube. Also an internal ledge or abutment is molded into the inside of each sealing member which is engaged by the upper end of a tube and restrains the axial upward force generated in the tube assembly in service. Corresponding sealing members are located in apertures which are provided in a lower header plate to support the tubes and lower header. As with upper sealing members the lower sealing members are resilient and of an inner diameter to be compressed when tubes are inserted and each lower sealing member also has an internal ledge against which the lower end of a tube abuts to restrain downward movement of the tube in service. In addition the lower portion of each tube is provided with a shoulder or flange which rests against the inner or tube side of each sealing member to further restrain downward movement of a respective tube.

To assemble the tubes of the first embodiment of the invention each tube is forced into an upper sealing member with an axial force to push the tube end past the internal ledge in each sealing member. This permits each tube to then be inserted into a lower sealing member until it engages the internal ledge of the lower sealing member and the shoulder on each tube engages the inner side of a lower sealing member. In the final assembly of each tube the upper end of each tube is lowered within the upper sealing member to engage the annular ledge located internally of each upper sealing member and restrain upward movement of each tube.

The other embodiments of the invention also permit insertion and removal of each tube from the tube assembly. In the second embodiment the shoulder or flange provided in the lower portion of the tubes is not used. Instead only the internal annular ledges in the upper and lower sealing members are employed to provide abutments which restrain upper and downward movement of the tubes in service as they are engaged in assembly by the upper and lower ends of each tube. In the third embodiment a shoulder or flange on the lower portion of each tube is employed to abut the inner end of each lower sealing member and to take the downward axial thrust of each tube in service and the internal annular ledge or abutment in the lower sealing members is eliminated. However, the internal annular ledge in the upper sealing members is employed to receive the upper ends of the tubes and the upward axial thrust to which each tube may be subjected in service.

In the last embodiment a pair of longitudinally spaced flanges on the tubes are used to engage the inner and outer ends or only the outer ends of the sealing members.

BRIEF DESCRIPTION OF THE INVENTION

Figure 1:
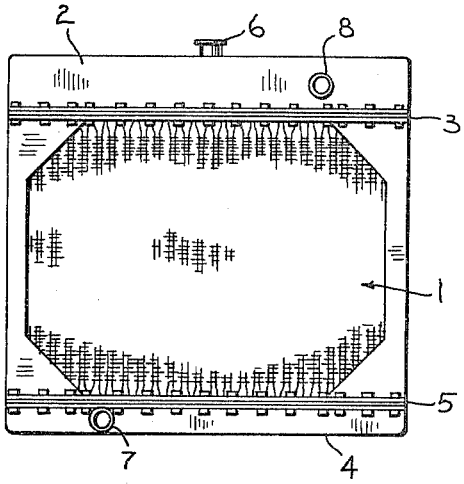
FIG. 1 is a schematic view of a radiator.
Figure 2:
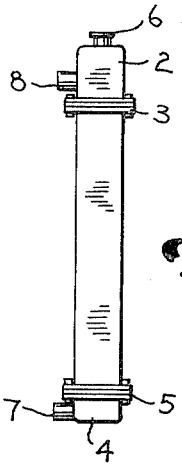
FIG. 2 is an end view of FIG. 1.

Referring to FIGS. 1 and 2 there is shown a heavy duty heat exchanger in the form of a radiator ordinarily of metal having a bank of tubes forming the core 1. The upper header 2 is supported on the upper plate 3 and the lower header 4 is supported on the lower header plate 5. Water is supplied to the upper header 2 through the capped inlet 6. The cooling water circulates through the core 1 and exits through pipe 7 to the system, not shown, to be cooled and returns to the upper header 2 through the inlet 8.

Figure 3:
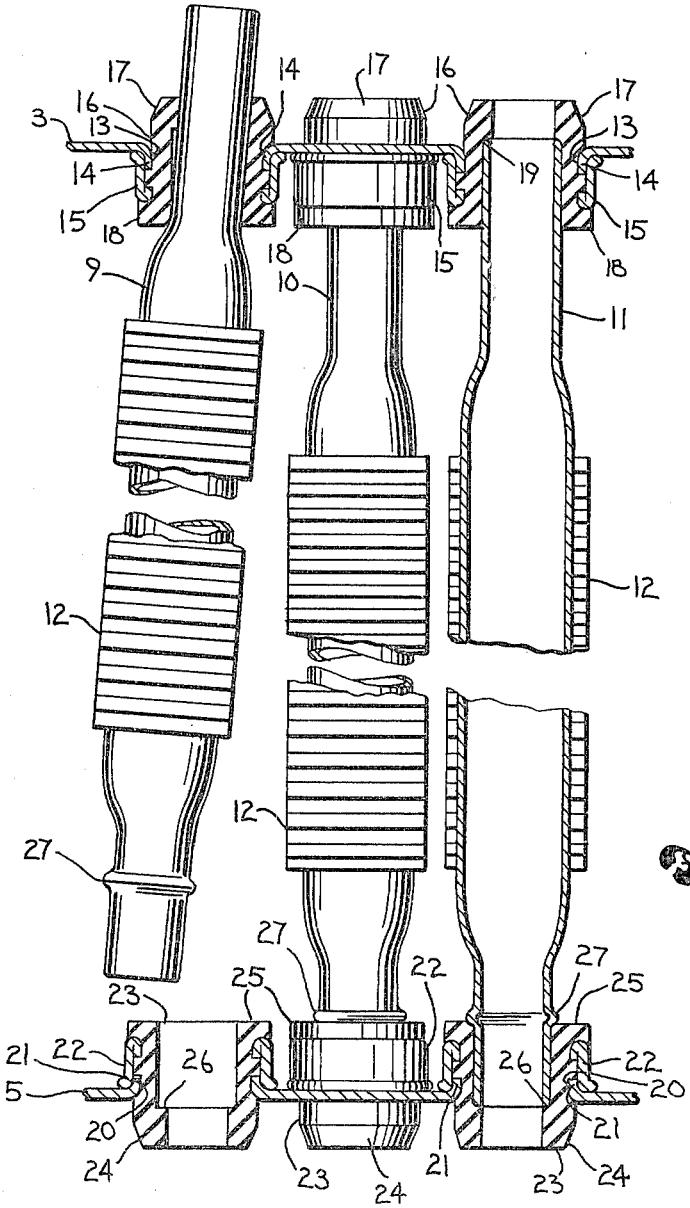
FIG. 3 is a front elevational view of a portion of a radiator with a tube in the process of removal or insertion with parts broken away and sectioned and which employs an internal ledge or abutment in both the upper and lower sealing members for the tubes and a flange on the lower portion of the tubes which engages the lower sealing members.

Referring first to the preferred embodiment of the invention illustrated in FIG. 3, there are shown circulating tubes 9, 10 and 11 of core 1 which carry the cooling fins 12. The tube 9 is shown in the process of being removed.

The upper plate 3 is provided with spaced apertures 13 each of which is provided in upper header plate 3 by an inwardly extending annular flange 14 which is encircled by the ferrule 15.

In order to provide an upper seal for the tubes 9, 10, 11 the upper header sealing member 16 is assembled within each flange 14 and ferrule 15 in the upper header plate 3. Each sealing member 16 is hollow and provided with an outer diameter to fit under compression within ferrule 15 and is slightly less than the outer diameter of tubes 9, 10, and 11 to be inserted therein. Upper sealing members 16 are of a resilient or elastic material to permit insertion of a tube therethrough and are of sufficient resilience to be compressed and grasp a tube such as 9, 10, or 11 to provide a leaktight seal therebetween. Satisfactory materials for sealing member 16 have been found to be elastomers such as, for example, silicone or neoprene.

The outer end of each sealing member 16 is inwardly tapered as at 17 to permit easy insertion of each member 16 in an aperture 13 of upper header plate 3. The inner end of each sealing member 16 has an annular flange 18 which seats against the ferrule 15.

The inside of each sealing member 16 is provided with an inwardly facing annular ledge or corresponding abutment 19 preferably located slightly above the upper plate 3. Ledge 19 is of sufficient width to provide a seat for the upper end of tube 9, 10, or 11 when these tubes are assembled to form core 1.

Figure 4:
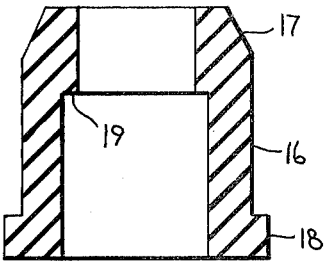
FIG. 4 is a sectional view of a sealing member employed in the first embodiment of the invention.

In FIG. 3, the construction of the lower header plate 5 conforms to that of the upper header plate 3 as do the lower sealing members. Thus lower header plate 5 has a plurality of spaced apertures 20 each formed from the lower header plate 5 by an annular flange 21 which is encircled by the ferrule 22. The sealing members 23 which correspond to upper sealing member 16 and as shown in FIG. 4 are hollow and of an outer diameter to fit in sealing engagement with each flange 21 and ferrule 22. The inner diameter of sealing members 23 are slightly less than the outer diameter of tubes 9, 10, and 11. The outer ends of the sealing members 23 are tapered as at 24 and each inner end has an annular outwardly extending flange 25 which abuts the ferrule 22. The inside of each sealing member 23 is provided with an inwardly facing annular ledge or abutment 26 against which is lodged tubes 9, 10, or 11 when the end portions of the tubes are assembled in sealing members 23 to form core 1.

As in the case of upper sealing member 16, the lower sealing members 23 are of a resilient elastic material in order to tightly grasp a fluid circulating tube inserted therein and provide a leakproof joint therebetween.

Referring further to fluid circulating tubes 9, 10, and 11, each tube on the lower end portion where the tubes are free of fins has an annular flange 27 which is ordinarily formed as part of the tube but can be a separate member secured to each tube. Flange 27 rests against flange 25 of the lower sealing members 23 on the inside of core 1.

In assembled position as particularly shown with respect to tube 11, for purposes of description and illustration, the upper end of the tube 11 within sealing member 16 abuts against the annular ledge 19 so in service the tube 11 is prevented from moving upwardly with respect to upper header plate 3.

Similarly the tube 11 at the lower end abuts against the annular ledge 26 of sealing member 23 which in service prevents tube 11 from moving downwardly with respect to lower header plate 5. The annular flange 27 of tube 11 which rests against the flange 25 of sealing member 23 also aids to prevent vertical downward movement of tube 11.

Core 1 has the described construction throughout with respect to each tube so that tubes such as tubes 9, 10, and 11 can be individually and separately easily removed and assembled in the event of injury to a respective tube without disassembling the entire core 1 and headers 2 and 4 of the radiator or heat exchanger.

Assuming that the tubes 9, 10, and 11 have been assembled in core 1 and that tube 9, for example, has suffered an injury due to the heavy service to which the radiator has been subjected, as previously noted it can easily be removed without disassembling any other part of the radiator.

Tube 9 is first grasped by the workman and pushed upwardly to overcome the restraint of the annular ledge 19 in the upper sealing member 16 as well as the tendency of sealing member 16 to be compressed against tube 9.

Tube 9 is pushed upwardly until the bottom end of tube 9 is free of the bottom sealing member 23. When the bottom end of tube 9 is free of sealing member 23, the workman then pulls the tube outwardly until clear of core 1 and then downward to pull tube 9 out of upper sealing member 16.

Figure 8:
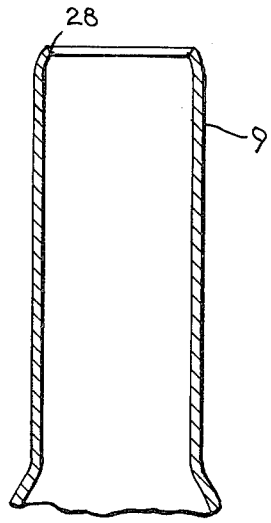
FIG. 8 is a sectional view of a portion of a tube illustrating the radius turning the end of the tube inwardly for easy insertion and passage through a sealing member.

Each tube 9 as well as tubes 10 and 11 and the other tubes making up core 1 are provided on opposite ends with a slight radius of the order of 0.06 of an inch so that the end of each tube is formed inwardly as at 28 as illustrated in FIG. 8. The radius makes it possible to readily insert a replacement tube through the sealing members as well as initially assemble the tubes with the header plates 3 and 5.

Thus to insert a new tube 9 for the one which has been described as removed because it was defective, new tube 9 is preferably lubricated initially at the upper end portion and then inserted into the upper sealing member 16. When annular ledge 19 of seal member 16 is engaged by the upper end of tube 9, an additional axial force is manually applied to tube 9 to push the end of tube 9 past ledge 19. The sealing member 16 will then stretch to allow passage of tube 9 through sealing member 16.

Thereafter the lower end of tube 9 is aligned with the lower sealing member 23 and inserted into member 23 and pushed downwardly until the end of new tube 9 engages ledges 19 and 26. At the same time the annular flange 27 on tube 9 engages flange 25 of sealing member 23 which combines with ledge 26 to prevent downward movement of tube 9 in service. The internal ledge 19 in upper sealing member 16 will in turn restrain upward movement of tube 9.

Figure 5:
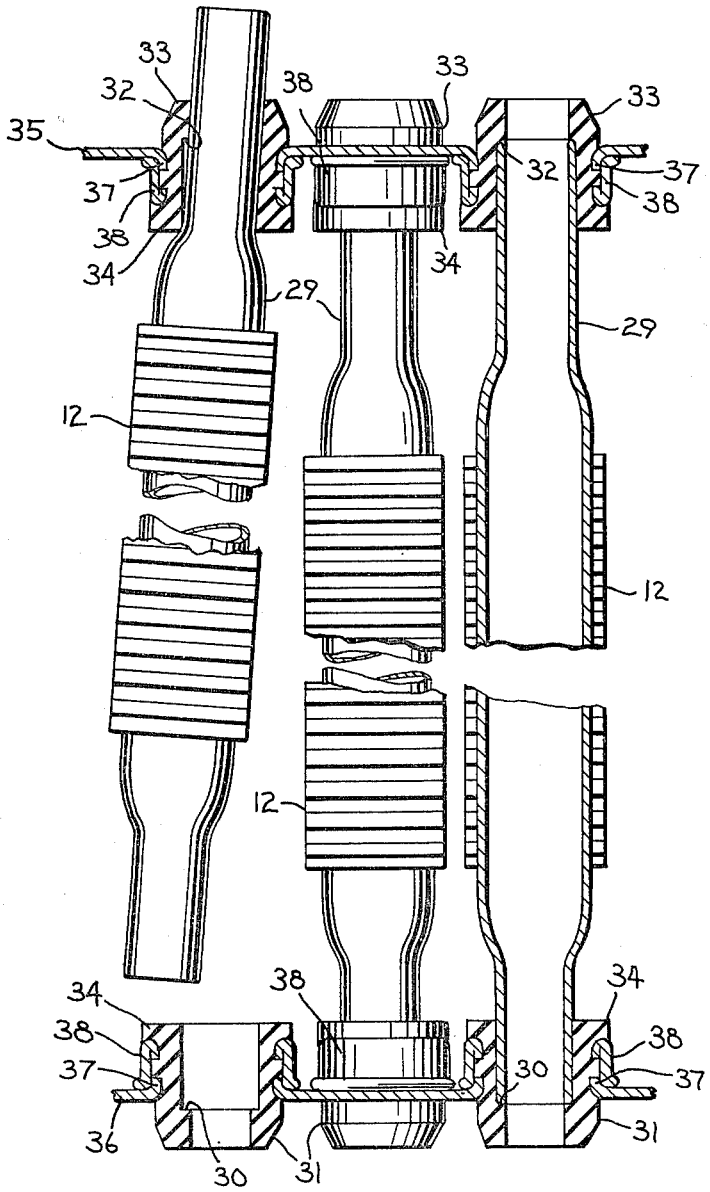
FIG. 5 is a view similar to FIG. 3 but with the flange on the lower portion of the tubes removed.

A second embodiment of the invention is illustrated in FIG. 5. In that embodiment, the flange 27 of the preferred embodiment is eliminated and the lower end of the tubes 29 engage the inwardly facing abutment or ledge 30 of each lower sealing members 31 while the upper end of tubes 29 engage the inwardly facing ledge 32 or abutment of the upper sealing member 33. This assembly restrains vertical movement of the tubes in service. A defective tube can readily be removed and replaced as described with respect to the first embodiment. Again the ends of the tubes in the second embodiment are inturned as at 28 of tube 9 illustrated in FIG. 8 for easy passage of the tubes through the sealing members.

The construction of the upper sealing members 33 and lower sealing members 31 in the second embodiment are the same as in the first embodiment with a flange 34 located on the inner end. However, the construction of the upper and lower header plates 35 and 36 are slightly different in that these plates are inwardly flanged as at 37 to provide apertures to receive sealing members 33 and 31. A ferrule 38 is secured to each flange 37 and extends the surface which is engaged by the respective sealing members 31 and 33.

Figure 6:
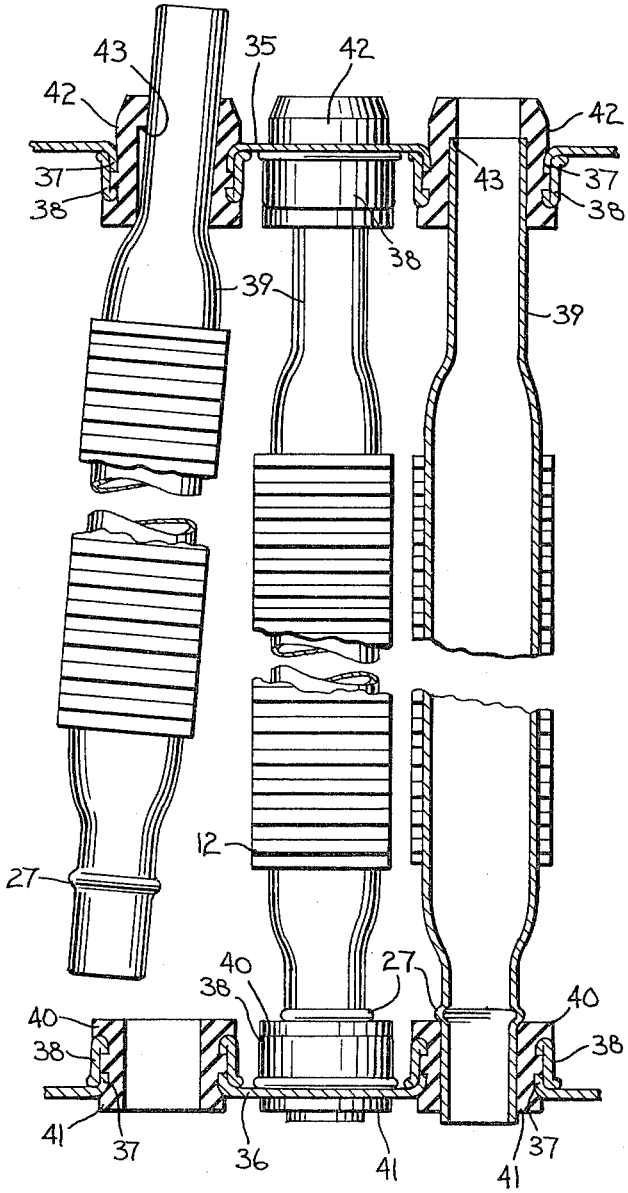
FIG. 6 is a view similar to FIG. 3 but with the internal ledge of the lower sealing member removed and a flange employed on the lower end portion of the tubes to engage the inner end of the sealing members.

A third embodiment of the invention is illustrated in FIG. 6. In that embodiment the flange 27 on each lower end portion of tubes 39 is restrained and engages the flange 40 on the inner end of each lower sealing member 41. However, in this embodiment each upper sealing member 42 has an annular ledge or abutment 43 on the inside against which the upper ends of the tubes 39 abut. The flange 27 and ledge 43 restrain vertical movement in opposite directions of tubes 39 in service. As in the first and second embodiments, the ends of tubes 39 are inwardly turned on a slight radius as illustrated at 28 of tube 9 in FIG. 8. Again a defective tube can readily be removed and replaced as described with respect to the first embodiment of the invention.

Figure 7:
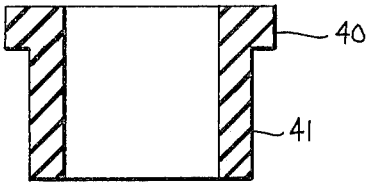
FIG. 7 is a sectional view of the lower sealing member employed with the tubes illustrated in FIG. 6.

The construction of the upper sealing members 42 is the same as the first and second embodiments and as illustrated in FIG. 4. However, the lower sealing members 41 are constructed as shown in FIG. 7 where only the single flange 40 is provided on the inner end of lower sealing member 41.

The construction of the header plates 35 and 36 correspond to the construction described and illustrated with respect to the second embodiment of the invention in which a ferrule 38 is secured to a flange 37 on each header plate. This extends the surface which is engaged by the respective sealing members 41 and 42.

Figure 9:
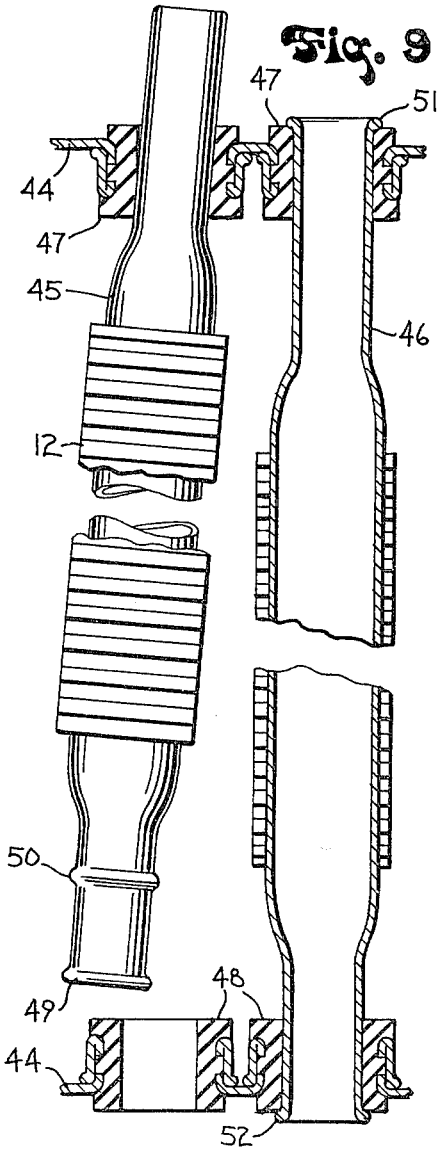
FIG. 9 is a sectional view of a further embodiment of the invention illustrating only the use of flanges to restrain vertical movement of the tubes.

A fourth embodiment of the heat exchanger of the invention is illustrated in two versions of tubes in FIG. 9 which ordinarily would not be employed together in a single core and which is shown with longitudinally spaced common upper and lower header plates 44. The upper end portion of tubes 45 and 46 respectively are shown as lodged in the upper sealing members 47 held by upper header plate 44. The lower end portions of tubes 45 and 46 respectively are shown as lodged in the lower sealing members 48 held by lower header plate 44. The sealing members 47 and 48 correspond in construction with lower sealing members 41 of the third embodiment and shown in FIG. 7 and FIG. 6.

A flange 49 is located on the lower end of tube 45 and a second flange 50 is secured or formed as part of tube 45 and located upwardly of flange 49. Upon assembly of the tube 45 in lower sealing member 48, the lowermost flange 49 engages the outer or header side of lower sealing members 48 to restrain upward movement of tube 45. The inner or tube side of sealing member 48 is engaged by flange 50 to restrain downward movement of tube 45. Although flanges 49 and 50 have been described as located on the lower end portions of tube 45 they could well be located on the upper end portion of tube 45 and thereby restrain opposite vertical movement of tube 45.

In order to remove tube 45 if it becomes defective, removal corresponds to the removal procedure described with respect to the first embodiment whereby the workman grasps the tube and pushes it upwardly to pull tube 45 and its end flange 49 through lower sealing member 48 until the tube is free. Tube 45 is then pulled sidewise of the core of the radiator and downwardly to remove it from upper sealing member 47. Insertion of a new tube to replace the defective tube is accomplished in much the same manner as described with respect to the first embodiment.

Also in FIG. 9 there is illustrated a somewhat different construction for tube 46 to restrain vertical movement of that tube in service. Tube 46 has upper and lower flanges 51 and 52 respectively at the ends of the tube. Upper flange 51 engages the outer of header side of upper sealing member 47 and lower flange 52 engages the outer or header side of lower sealing member 48. The described engagement of the flanges 51 and 52 with the sealing members restrains tube 46 against vertical movement in service.

In order to remove tube 46 removal corresponds to the removal procedure described with respect to the first embodiment whereby the workman grasps tube 46 and either pushes it upwardly to free the lower flange 52 from lower sealing member 48 or the workman pulls it downwardly to clear the upper end of tube 46 from upper sealing member 47. In either case tube 46 after one of the first described maneuvers is pulled outwardly and then either pulled downwardly or upwardly, as the case may be, to remove tube 46 from the core. Insertion of a new tube to replace the defective tube is accomplished in much the same manner as described with respect to the first embodiment.

The invention provides a novel arrangement of installing and holding removable heat exchanger tube assemblies such as those employed in heavy duty equipment radiators.

Various modes of carrying out the invention are contemplated as being within the scope of the following claims particularly pointing out and distinctly claiming the subject matter which is regarded as the invention.

I claim:

1. In a tube assembly for heavy duty heat exchangers having individually removable tubes, first and second support plates longitudinally spaced from each other and having a series of longitudinally aligned apertures therein, a hollow generally resilient sealing member securely disposed in each aperture in the support plates and the sealing members in the apertures in the first support plate having an inwardly facing abutment means projecting into the apertures in the sealing members and normally preventing movement of the tubes longitudinally outwardly of the sealing members, said abutment means being disposed slightly outwardly of the first support plate to permit stretching of each sealing member in an area free of the backing of the first support plate when an individual tube is pushed through a respective sealing member in a direction outwardly to free the opposite end of the tube from the second support plate and effect removal of the tube sideways of the heat exchanger for replacement, a plurality of individually removable heat exchanger tubes extending between the plates with the one end of each tube lodged against an abutment in the sealing members in the first support plate and with the opposite end of the tubes extending through the hollow sealing members in the second support plate, and second abutment means assembled with the sealing members of the second support plate to limit longitudinal movement of the tubes, said second abutment means being a combination of an internal inwardly facing annular ledge disposed in the inside diameter of each sealing member in the second plate and engaged by the respective end of a tube or tube assembly and a flange on the lower portion of each tube which engages the inner side of each sealing member of the second plate.

2. In a heavy duty heat exchanger having separately removable tubes, a pair of header plates longitudinally spaced from each other and having a plurality of longitudinal aligned apertures therein, a sealing member disposed in each aperture, fluid circulating tubes having their opposite end portions located in the oppositely disposed sealing members, flange means on each tube engaging a sealing member to limit movement of the tubes in opposite longitudinal directions, and the flange means on each tube being a first flange engaging the outer end of a sealing member, and a second flange on the same end of the tube as the first named flange and longitudinally spaced from the first named flange and engaging the inner end of the said sealing member, the said flanges limiting movement of each tube in opposite longitudinal directions.

* * * * *